US011707774B2

(12) United States Patent
Tachibana et al.

(10) Patent No.: US 11,707,774 B2
(45) Date of Patent: Jul. 25, 2023

(54) BENDING METHOD

(71) Applicants: MITSUBISHI HEAVY INDUSTRIES, LTD., Tokyo (JP); AISIN KEIKINZOKU KABUSHIKI KAISHA, Imizu (JP)

(72) Inventors: Takahiro Tachibana, Tokyo (JP); Jin Shinmura, Toyama (JP); Arata Yoshida, Toyama (JP); Hiroaki Matsui, Toyama (JP)

(73) Assignees: MITSUBISHI HEAVY INDUSTRIES, LTD., Tokyo (JP); AISIN KEIKINZOKU KABUSHIKI KAISHA, Imizu (JP)

( * ) Notice: Subject to any disclaimer, the term of this patent is extended or adjusted under 35 U.S.C. 154(b) by 127 days.

(21) Appl. No.: 17/342,797

(22) Filed: Jun. 9, 2021

(65) Prior Publication Data

US 2021/0291247 A1 Sep. 23, 2021

Related U.S. Application Data

(62) Division of application No. 15/567,525, filed as application No. PCT/JP2016/062932 on Apr. 25, 2016, now abandoned.

(30) Foreign Application Priority Data

Apr. 27, 2015 (JP) ..... 2015-090307

(51) Int. Cl.
*B21D 7/08* (2006.01)
*B21B 1/09* (2006.01)
(Continued)

(52) U.S. Cl.
CPC ..... *B21D 7/08* (2013.01); *B21B 1/088* (2013.01); *B21B 1/09* (2013.01); *B21B 1/092* (2013.01);
(Continued)

(58) Field of Classification Search
CPC ..... B21D 7/08; B21D 11/08; B21D 35/006; B21B 1/088; B21B 1/09; B21B 1/095;
(Continued)

(56) References Cited

U.S. PATENT DOCUMENTS 5,979,205 A * 11/1999 Uchida ..... B23P 15/00 72/167
2010/0088882 A1* 4/2010 Tomizawa ..... C21D 1/34 72/342.6
2012/0297624 A1* 11/2012 He ..... B21D 11/08 29/898.04

* cited by examiner

*Primary Examiner* — Teresa M Ekiert
(74) *Attorney, Agent, or Firm* — Manabu Kanesaka; Benjamin Hauptman; Kenneth Berner

(57) ABSTRACT

A workpiece material is fed between rollers to bend the workpiece material while rolling, wherein the workpiece has a first thickness portion and a second thickness portion connected to each other with a setting angle of 90 degrees. The first thickness portion increases from an inner side toward an outer side, and a thickness on an outer peripheral side of the first thickness portion is M, and a thickness of a cross section of the second thickness portion is N. The workpiece material is rolled in such that at a completion of bending, a thickness of a cross section of a first thickness portion is m, an outer radius of the first thickness portion is R, an inner radius of the first thickness portion is r, and a thickness of a cross section of a second thickness portion is n, and M equals to m(R/r), and N equals to n(R/r).

2 Claims, 10 Drawing Sheets

(51) Int. Cl.

| | |
|---|---|
| ***B21B 1/092*** | (2006.01) |
| ***B21B 1/095*** | (2006.01) |
| ***B21B 13/10*** | (2006.01) |
| ***B21B 1/098*** | (2006.01) |
| ***B21D 11/08*** | (2006.01) |
| ***B21B 1/088*** | (2006.01) |
| ***B21B 39/10*** | (2006.01) |
| ***B21D 11/20*** | (2006.01) |

(52) U.S. Cl.
CPC ..... *B21B 1/095* (2013.01); *B21B 1/098* (2013.01); *B21B 13/10* (2013.01); *B21B 39/10* (2013.01); *B21D 11/08* (2013.01); *B21D 11/20* (2013.01)

(58) Field of Classification Search
CPC ..... B21B 1/098; B21B 1/092; B21B 13/10; B21B 39/10
See application file for complete search history.

BEFORE BENDING

AFTER BENDING

BEFORE BENDING

AFTER BENDING

BENDING METHOD

CROSS-REFERENCE TO RELATED APPLICATION

This is a divisional patent application of Ser. No. 15/567,525 filed Oct. 18, 2017, which is a National Phase of International Application No. PCT/JP2016/062932 filed Apr. 25, 2016, and claims priority of Japanese Patent Application No. 2015-090307 filed Apr. 27, 2015, the disclosure of which is hereby incorporated by reference herein in its entirety.

TECHNICAL FIELD

The present invention relates to a bending method which bends the metal material by using a rolling machine.

BACKGROUND ART

A bending method or so-called rolling is disclosed, for example, in PTL 1, in which a long workpiece material (metal material) is sent in a longitudinal direction and bent while being pressed by a plurality of rollers. As illustrated in FIG. 10, the rolling forms a workpiece material a into a bent shape by pressing a plurality of rollers b, c, and d and rollers e, f, and g against one and the other sides of the workpiece material a, respectively, and sending the workpiece material a in the longitudinal direction with the type (such as the diameter or shape) and the fixed position of each of the rollers b to g being set appropriately.

CITATION LIST

Patent Literature

{PTL 1} PCT International Publication No. WO 2008/123505

SUMMARY OF INVENTION

Technical Problem

According to the aforementioned rolling method, however, a degree of compression and deformation in a region corresponding to an inner peripheral side of the bend radius of the workpiece material a, which has been bent, tends to be greater than a degree of tension and deformation in a region corresponding to an outer peripheral side of the bend radius, as indicated by large and small arrows in FIG. 10. As a result, the material undergoes deformation intensively in the inner side region and results in having buckling or warpage, so that the shape accuracy after the rolling is reduced and fixing work is required.

Particularly, when the workpiece material a has a cross-sectional shape such as an H shape (I shape), an L shape, a channel shape, or a crank shape (Z shape) with a plurality of thickness portions disposed at different angles, it has been impossible to bend the material while simultaneously rolling all of the plurality of thickness portions. This causes one surface to be rolled and another to be unrolled where the rolled surface has the thickness smaller than a target value whereas the unrolled surface has a large residual stress remaining thereon, so that a distortion, a crack, or the like is formed in some cases depending on the material, the cross-sectional shape, or the bent shape.

The present invention has been made in view of such circumstances, and an object of the invention is to provide a rolling machine, a bending method, and a workpiece material with which the shape accuracy after bending can be increased by preventing an intensive deformation in a specific portion of the workpiece material.

Solution to Problem

In order to solve the aforementioned problems, the present invention adopts the following solutions.

That is, a rolling machine according to the present invention is capable of simultaneously rolling two or more of a plurality of thickness portions of a long workpiece material made of metal, the plurality of thickness portions being disposed at different angles, and the machine including a plurality of roller units each including one roller that is pressed against one surface of the thickness portion and another roller that is pressed against another surface of the thickness portion. At least one of the plurality of roller units rolls the thickness portion different from the thickness portion that is rolled by another one of the roller units.

According to the rolling machine having the aforementioned configuration, the plurality of thickness portions can be rolled simultaneously by simultaneously pressing the plurality of rollers against the plurality of thickness portions of the workpiece material disposed at the different angles. This can prevent a situation where a specific portion of the workpiece material is deformed intensively and can increase the shape accuracy after bending with the residual stress being reduced.

A bending method according to the present invention feeds a long workpiece material made of metal and having a plurality of thickness portions disposed at different angles between rollers and bends the workpiece material while rolling the workpiece material with the rollers. According to the bending method, an initial shape of the workpiece material is a straight line or a bend with a bend radius dimension larger than a target bend radius dimension, a thickness dimension of a cross section of the workpiece material along a bend radius direction is set to increase from an inner side toward an outer side of the bend radius direction, the workpiece material is fed between the rollers and rolled in a way that an amount of rolling in a region corresponding to the outer side of the bend radius direction is larger than an amount of rolling in a region corresponding to the inner side, and the workpiece material is bent to have the target bend radius dimension from the initial shape.

According to the bending method, an amount of stretch in a longitudinal direction of the region corresponding to the outer side of the bend radius direction of the workpiece material rolled by the rollers is larger than an amount of stretch of the region corresponding to the inner side of the bend radius direction, so that the workpiece material is bent by a difference in the amount of stretch between the inner and outer sides. The amount of stretch (amount of rolling) in the longitudinal direction changes linearly along the width direction, or increases gradually toward the outer peripheral side.

As a result, there can be prevented a situation where, as is the case with conventional rolling, one part inside the workpiece material is deformed while another part is not, or a situation where a specific portion is deformed intensively. This can prevent stress from remaining in an unrolled part, which increases the shape accuracy after bending.

According to the bending method, with regard to the thickness dimension of the cross section of the workpiece material along the bend radius direction, a thickness dimension on an inner peripheral part of a bend radius is preferably set to a target thickness dimension at the completion of bending, and a thickness dimension on an outer peripheral part of the bend radius is preferably set to a dimension obtained by multiplying the target thickness dimension by a value that is obtained by dividing an outer radius dimension of the workpiece material by an inner radius dimension of the workpiece material at the completion of bending.

As a result, the thickness dimension of each part of the initial shape can be set easily and reliably from the cross-sectional shape and the bend radius of the workpiece material after subjected to bending.

A workpiece material according to the present invention is used when a long workpiece material made of metal is fed between rollers and bent while being rolled by the rollers, where a thickness dimension of a cross section of the workpiece material along a bend radius direction is set to increase from an inner side toward an outer side of the bend radius direction.

The workpiece material is rolled by the rollers so that the amount of rolling and the amount of stretch along the longitudinal direction in a region corresponding to the outer side of the bend radius direction are larger than the amount of rolling and the amount of stretch in a region corresponding to the inner side of the bend radius direction, and that the material is bent by the difference in the amount of stretch between the inner and outer sides. The amount of stretch (amount of rolling) in the longitudinal direction changes linearly along the width direction, or increases gradually toward the outer peripheral side.

As a result, there can be prevented a situation where one part inside the workpiece material is deformed while another part is not, or a situation where a specific portion is deformed intensively. This can prevent stress from remaining in an unrolled part, which increases the shape accuracy after bending.

Advantageous Effects of Invention

According to the rolling machine, the bending method, and the workpiece material of the present invention described above, a situation can be prevented where a specific portion of the workpiece material being bent is deformed intensively, which increases the shape accuracy after bending and allows for avoiding fixing work after bending.

DESCRIPTION OF EMBODIMENTS

A plurality of embodiments according to the present invention will now be described with reference to the drawings.

First Embodiment

Figure 1A:
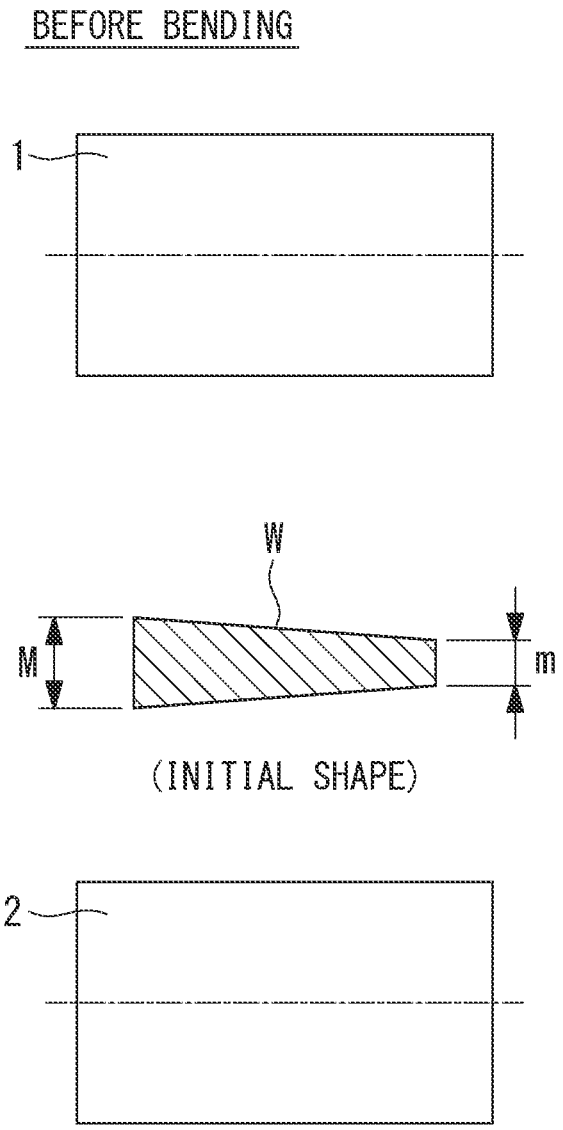
FIG. 1A is a longitudinal section of a workpiece material and rollers before bending, according to a first embodiment of the present invention.
Figure 1B:
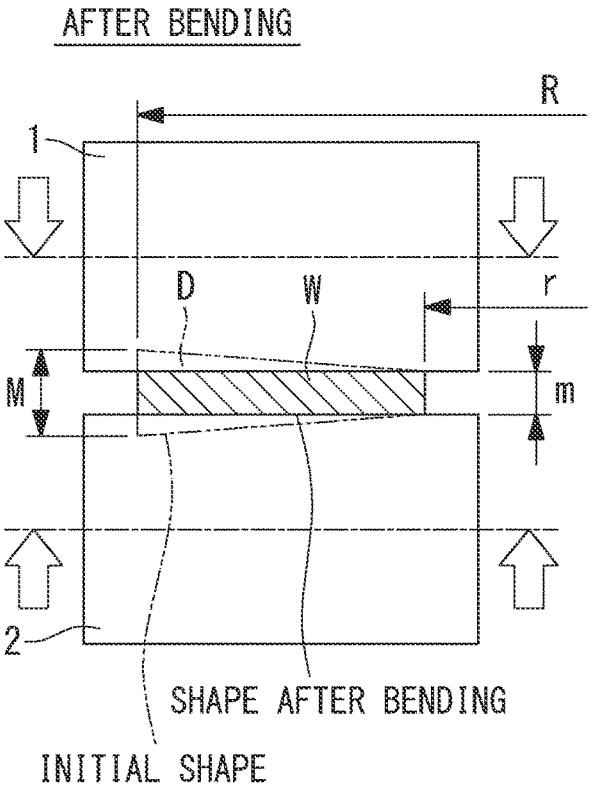
FIG. 1B is a longitudinal section of the workpiece material and the rollers after bending, according to the first embodiment of the present invention.
Figure 2:
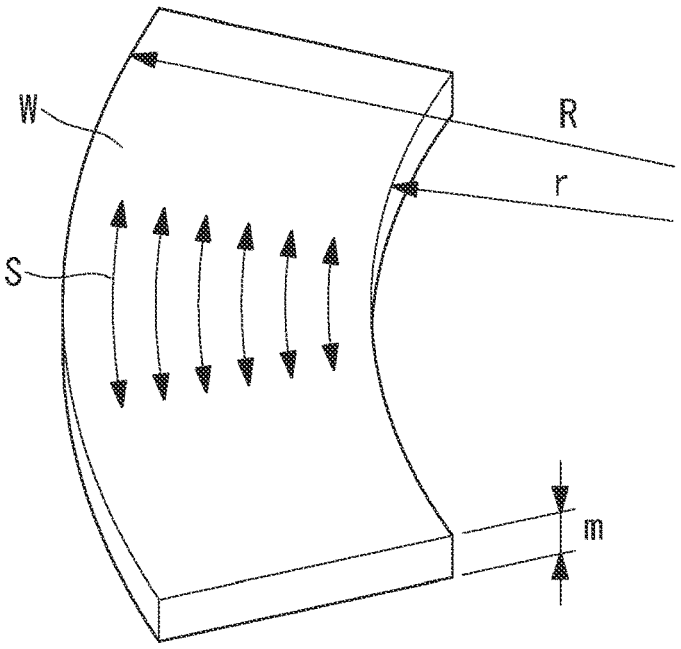
FIG. 2 is a perspective view of the workpiece material which has been bent.

FIGS. 1A and 1B are longitudinal sections of a workpiece material and rollers according to a first embodiment of the present invention, where FIG. 1A illustrates a state before bending and FIG. 1B illustrates a state after bending. FIG. 2 is a perspective view of the workpiece material which has been bent.

A bending method according to the present invention sends a long workpiece material W made of a metal material such as an aluminum alloy or steel between two rollers 1 and 2 disposed in parallel to each other, for example, and bends the workpiece material W while rolling the material with the rollers 1 and 2.

The workpiece material W is formed as a strip, for example, an initial shape of which is a straight line or a bend with a larger bend radius dimension than a target bend radius dimension. The initial shape of the workpiece material is the straight line in the present embodiment.

When r represents an inner radius of the workpiece material W after subjected to bending, R represents an outer radius of the material, m represents the thickness dimension of an inner peripheral edge of the material, and M represents the thickness dimension of an outer peripheral edge of the material before subjected to bending, the thickness dimension of a cross section along a bend radius direction r (R) of the material in its initial shape before subjected to bending is set to increase from the inner side (m) toward the outer side (M) of the bend radius direction r (R). Here, the thickness dimension m on the inner peripheral side is set to a value equal to a target thickness dimension (final dimension) at the completion of bending or close thereto, whereas the thickness dimension M on the outer peripheral side is set to a dimension obtained by multiplying the target thickness dimension m by a value that is obtained by dividing the outer radius dimension R of the workpiece material W by the inner radius dimension r at the completion of bending. That is, M can be found by the following expression.

$$M=m(R/r)$$

This allows the thickness dimension of each part in the initial shape to be set easily and reliably from the cross-sectional shape and the bend radius of the workpiece material W after subjected to bending.

The workpiece material W formed in the aforementioned manner is then fed between the rollers 1 and 2 and rolled. According to the bending method and the workpiece material W, the thickness dimension (m to M) of the cross section of the workpiece material W along the bend radius direction r (R) is set to increase from the inner side toward the outer side of the bend radius direction, so that an amount of rolling D by the rollers 1 and 2 increases from a region on the inner side (near m) toward a region on the outer side (near M) along the bend radius direction as illustrated in FIG. 1B. At the same time, as illustrated in FIG. 2, an amount of stretch S of the workpiece material W in the longitudinal direction increases from the inner side toward the outer side along the bend radius direction so that the workpiece material W is bent by a difference in the amount of stretch S between the inner and outer sides.

The amount of rolling D in the thickness direction and the amount of stretch S in the longitudinal direction of the workpiece material W change linearly along the width direction of the workpiece material W, or increase gradually toward the outer peripheral side. As a result, there can be prevented a situation where, as is the case with conventional rolling, one part inside the workpiece material W is deformed while another part is not, or a situation where a specific portion is deformed intensively. This can prevent stress from remaining in an unrolled part, which increases the shape accuracy after bending and allows for avoiding fixing work after bending.

Second Embodiment

Figure 3:
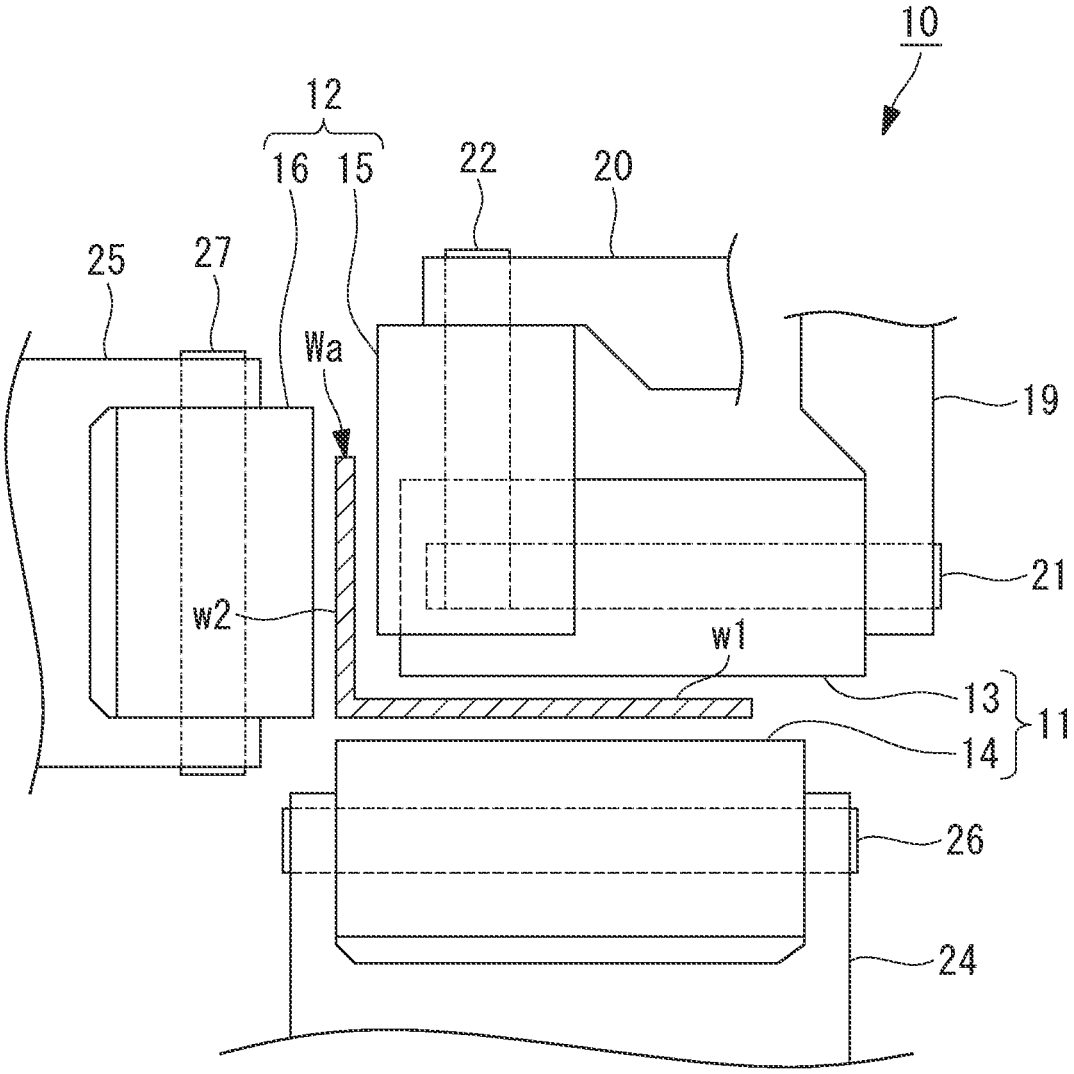
FIG. 3 is a front view of a rolling machine according to a second embodiment of the present invention.
Figure 4:
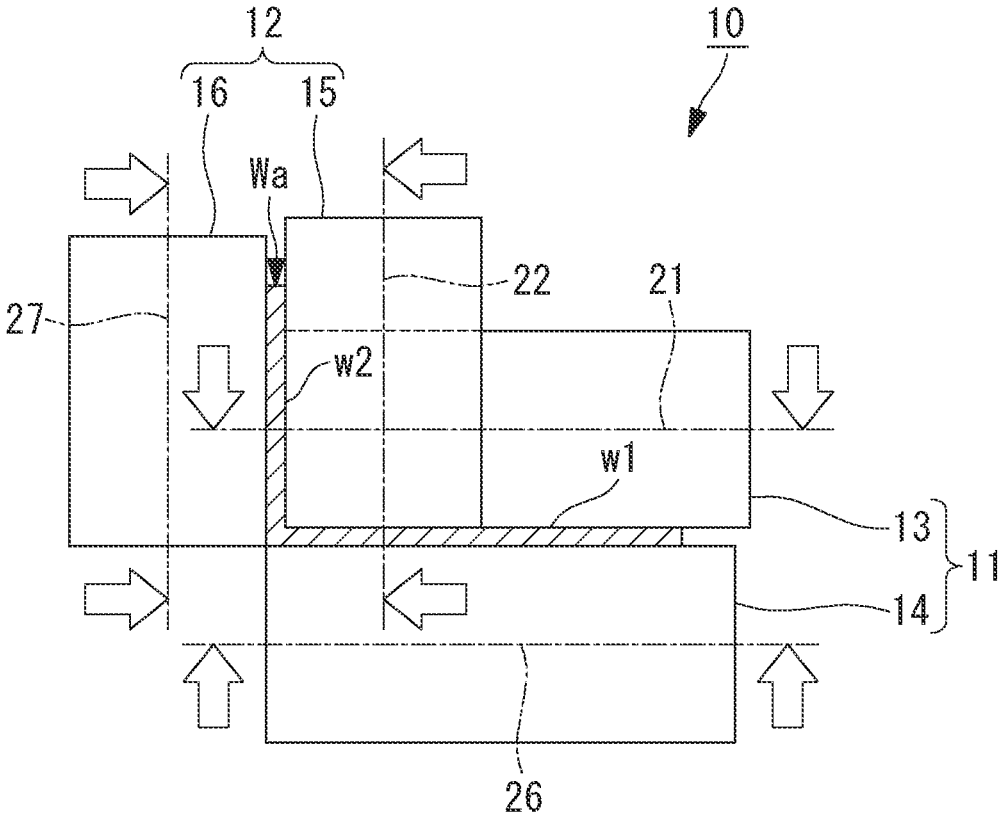
FIG. 4 is a front view illustrating a state in which a workpiece material with an L-shaped cross section is bent by the rolling machine.

FIG. 3 is a front view of a rolling machine according to a second embodiment of the present invention, and FIG. 4 is a front view illustrating a state in which a workpiece material with an L-shaped cross section is bent by the rolling machine.

A rolling machine 10 can roll a long workpiece material Wa made of metal such as an aluminum alloy or steel, for example. The workpiece material Wa illustrated in FIGS. 3 and 4 has the L-shaped cross section with two thickness portions w1 and w2 forming a setting angle of 90 degrees, for example. The rolling machine 10 can roll the thickness portions w1 and w2 simultaneously.

The rolling machine 10 includes a roller unit 11 rolling the thickness portion w1 of the workpiece material Wa, and a roller unit 12 rolling the thickness portion w2 of the workpiece material Wa. The roller unit 11 includes a cylindrical roller 13 (one roller) pressed against one surface of the thickness portion w1, and a cylindrical roller 14 (another roller) pressed against another surface of the thickness portion w1. The cylindrical rollers 13 and 14 face each other with the thickness portion w1 interposed therebetween.

The roller unit 12 includes a cylindrical roller 15 (one roller) pressed against one surface of the thickness portion w2, and a cylindrical roller 16 (another roller) pressed against another surface of the thickness portion w2. The cylindrical rollers 15 and 16 face each other with the thickness portion w2 interposed therebetween.

The cylindrical rollers 13 and 15 are rotatably supported about shafts 21 and 22 that are supported in a cantilevered manner by roller arms 19 and 20, respectively. The cylindrical rollers 14 and 16 are rotatably supported about shafts 26 and 27 that are supported at both ends by roller frames 24 and 25, respectively.

The roller arm 19 and the roller frame 24 of the roller unit 11 can each move independently in a direction orthogonal to a surface direction of the thickness portion w1. The cylindrical rollers 13 and 14 can thus be pressed against the both surfaces of the thickness portion w1 and roll the thickness portion w1.

The roller arm 20 and the roller frame 25 of the roller unit 12 can each move independently in a direction orthogonal to a surface direction of the thickness portion w2. The cylindrical rollers 15 and 16 can thus be pressed against the both surfaces of the thickness portion w2 and roll the thickness portion w2.

One of the roller units 11 and 12 has a roller shaft angle different from that of the other roller unit. That is, as illustrated in FIGS. 3 and 4, the roller shaft angle of the roller unit 11 rolling the thickness portion w1 of the workpiece material Wa is horizontal, for example, while the roller shaft angle of the roller unit 12 rolling the thickness portion w2 is vertical, for example.

As a result, the one and the other roller units 11 and 12 can each roll a different thickness portion being one of the thickness portions w1 and w2. It is needless to say that the roller shaft angles of the roller units 11 and 12 are not limited to the horizontal and vertical angles but may be set to other angles. Alternatively, the roller shaft angles of the roller units 11 and 12 may be variable.

Although the four cylindrical rollers 13, 14, 15, and 16 are roughly held by the aforementioned structure, such holding structure as well as the position, number, direction of movement, and the like of the rollers are not limited to those illustrated above. For example, the pair of rollers facing each other need not both be movable, where one of the rollers may be fixed to a structure or the like to receive the pressing force from the other roller. Moreover, the shape of the roller is not limited to the cylinder but may be a cone or the like.

The rolling machine 10 having the aforementioned structure is used to roll the workpiece material Wa in which the thickness of each of the thickness portions w1 and w2 before rolling is set as illustrated in FIG. 5, so that the two thickness portions w1 and w2 disposed at different angles can be bent while being rolled from both sides thereof simultaneously.

Figure 5A:
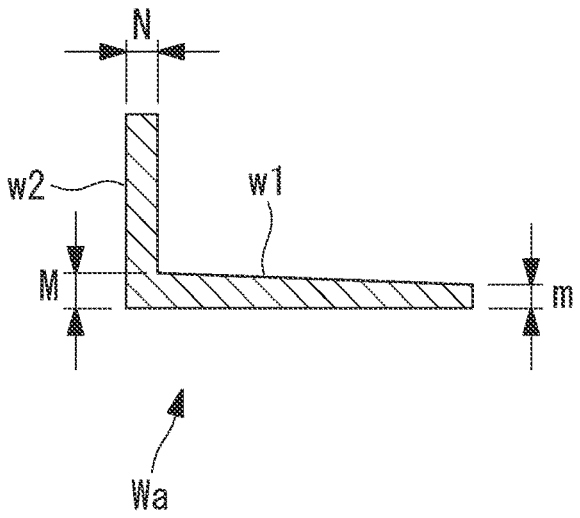
FIG. 5A is a longitudinal section of the workpiece material with the L-shaped cross section before subjected to bending.
Figure 5B:
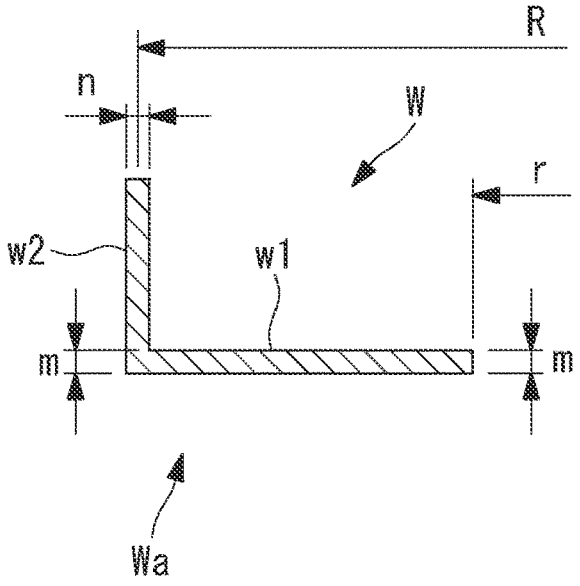
FIG. 5B is a longitudinal section of the workpiece material with the L-shaped cross section after subjected to bending.

FIG. 5A is a longitudinal section of the workpiece material Wa before subjected to bending, and FIG. 5B illustrates the material after subjected to bending. When r represents an inner radius of the workpiece material Wa after subjected to bending, R represents an outer radius of the material, m represents the thickness dimension of an inner peripheral edge of the thickness portion w1, and M represents the thickness dimension of an outer peripheral edge of the material before subjected to bending, the thickness dimension m to M of each part in a cross section along a bend radius direction r (R) of the material in its initial shape before subjected to bending is set to increase from the inner side toward the outer side of the bend radius direction r (R). When N represents the thickness dimension of the thickness portion w2 before subjected to bending, the thickness dimension N is set larger than a target thickness dimension n (final dimension) at the completion of bending.

Here, the thickness dimension m on the inner peripheral side of the thickness portion w1 is set to a value equal to a target thickness dimension (final dimension) at the completion of bending or close thereto, whereas the thickness dimension M on the outer peripheral side of the thickness portion w1 and the thickness dimension N of the thickness portion w2 are set to dimensions obtained by multiplying the target thickness dimensions m and n by a value that is obtained by dividing the outer radius dimension R by the inner radius dimension r at the completion of bending, respectively. That is, M and N can be found by the following expressions.

$$M=m(R/r)$$

$$N=n(R/r)$$

The workpiece material Wa formed in the aforementioned manner is then fed between cylindrical rollers 13, 14, 15, and 16 of the rolling machine 10 so that the plurality of thickness portions w1 and w2 are rolled simultaneously and bent. At this time, the thickness portion w1 is rolled between the cylindrical rollers 13 and 14, while the thickness portion w2 is rolled between the cylindrical rollers 15 and 16.

The thickness dimensions n and N and m and M of the parts in the workpiece material Wa (w1 and w2) are set to increase from the inner side toward the outer side along the bend radius direction r (R) as illustrated in FIGS. 5A and 5B so that, as with the first embodiment, an amount of deformation by rolling (amount of rolling) increases from a region on the inner side toward a region on the outer side along the bend radius direction r (R). As a result, an amount of stretch of the workpiece material Wa in the longitudinal direction increases from the inner side toward the outer side along the bend radius direction so that the workpiece material Wa is bent by a difference in the amount of stretch between the inner and outer sides.

Figure 6:
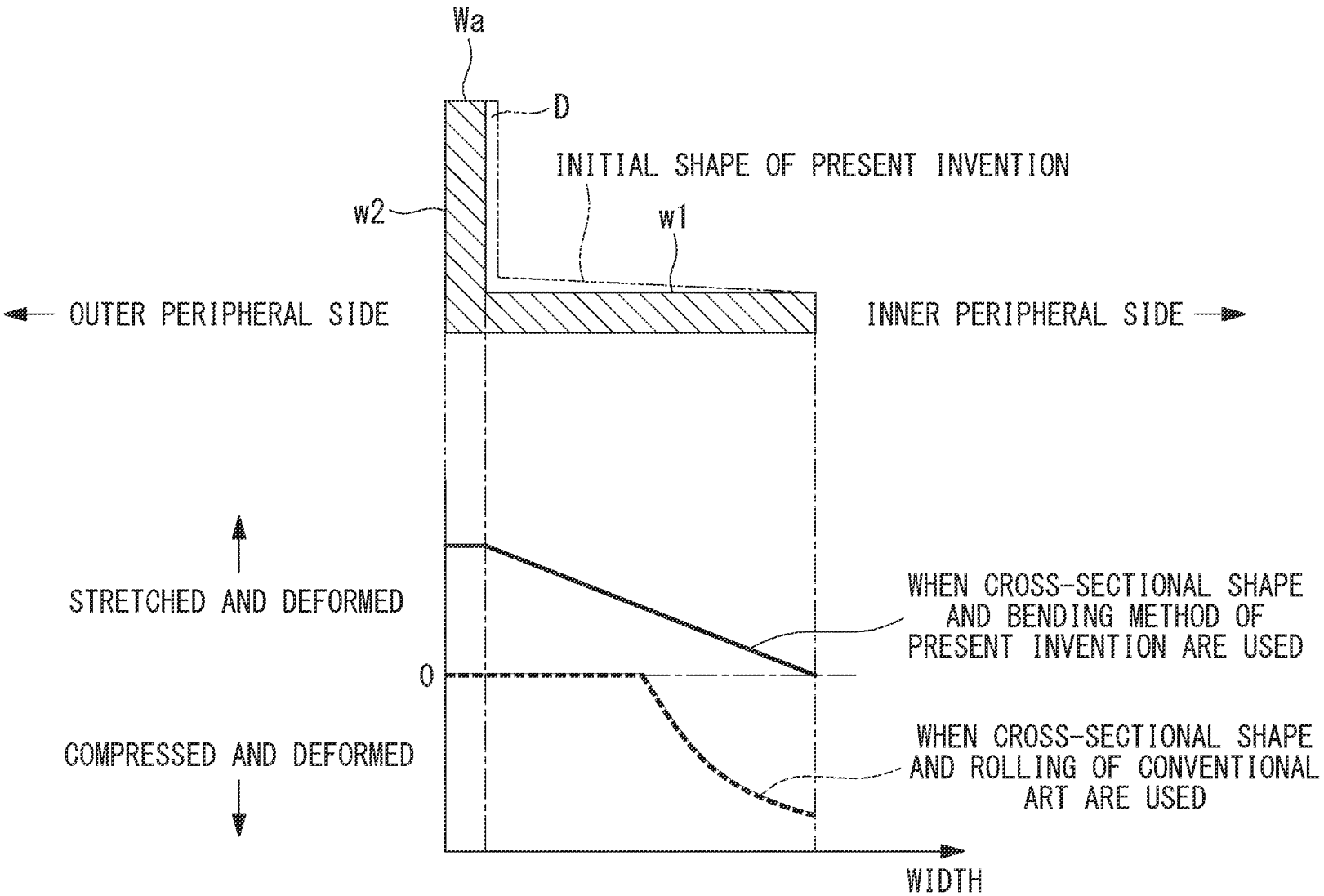
FIG. 6 is a graph comparing an amount of rolling at each part of a product made of the workpiece material bent by the rolling machine of the present invention with a corresponding part of a product made of a conventional material using a conventional rolling technique.

FIG. 6 is a graph comparing the amount of deformation at parts of a product made of the workpiece material Wa bent by the rolling machine 10 of the present invention with corresponding parts of a product made of a conventional material using a conventional rolling technique. According to the present embodiment, as indicated by a solid line on the graph, the amount of deformation (amount of rolling D) in the workpiece material Wa increases linearly from the inner peripheral side toward the outer peripheral side along the bend radius direction. This can prevent a situation where a specific portion of the workpiece material Wa is deformed intensively, which can reduce the residual stress and thus increase the shape accuracy after bending.

On the other hand, for the product made of the conventional material (with a cross-sectional shape of the material) using the conventional rolling technique, the degree of compression and deformation in the region corresponding to the inner peripheral side of the bend radius is greater than the degree of tension and deformation in the region corresponding to the outer peripheral side of the bend radius as described above. Therefore, as indicated by a dashed line on the graph, the material undergoes compression and deformation intensively in the inner side region and results in having buckling or warpage so that the shape accuracy after the rolling is reduced and that fixing work is required.

Note that the present invention is not limited to the configuration of each of the embodiments described above but changes and/or modifications can be made as appropriate without departing from the scope of the present invention, where an embodiment to which such changes and/or modifications are made is also included in the scope of rights of the present invention.

Figure 7A:
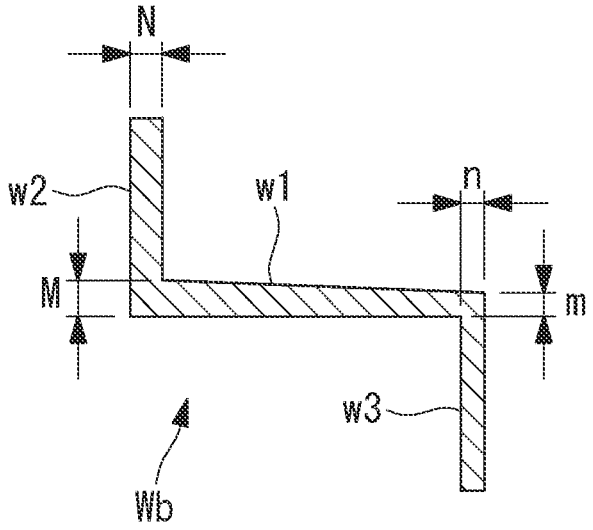
FIG. 7A is a longitudinal section of a workpiece material with a crank-shaped cross section before subjected to bending.
Figure 7B:
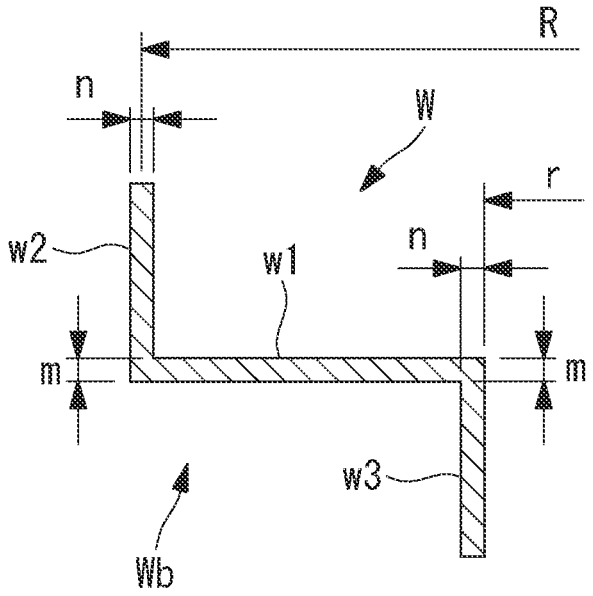
FIG. 7B is a longitudinal section of the workpiece material with the crank-shaped cross section after subjected to bending.
Figure 8A:
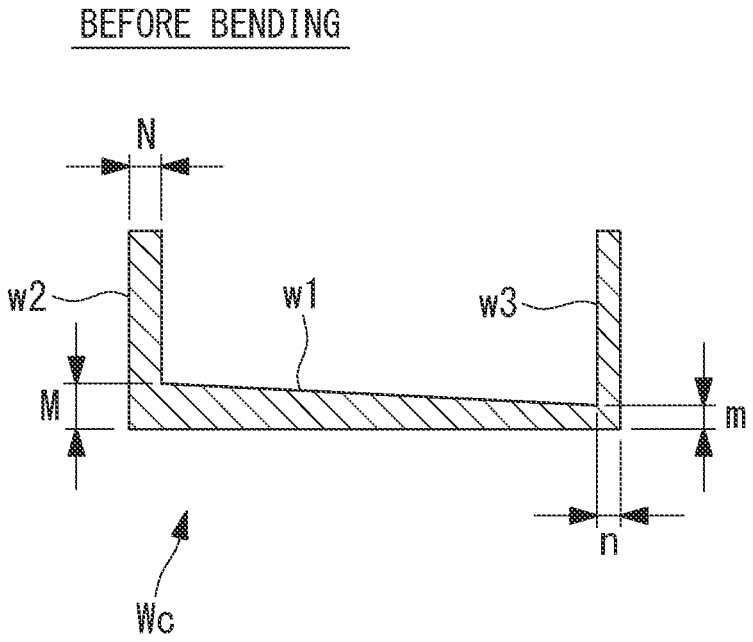
FIG. 8A is a longitudinal section of a workpiece material with a channel-shaped cross section before subjected to bending.
Figure 8B:
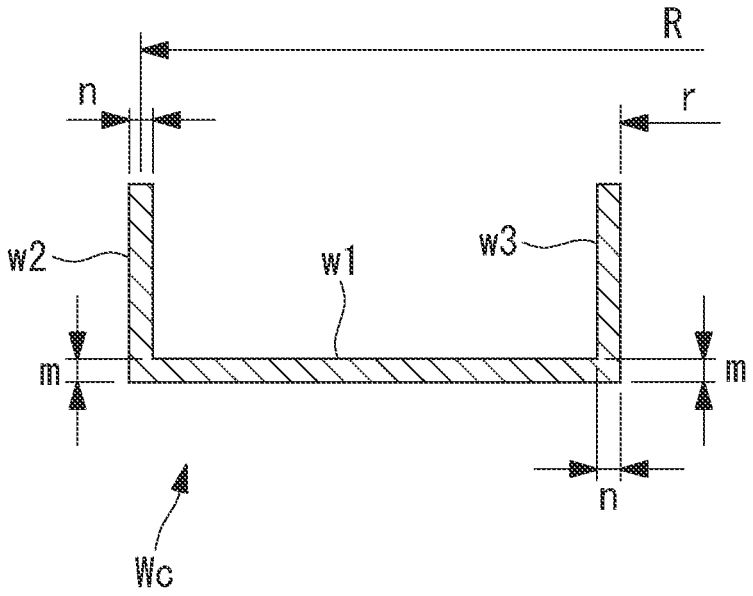
FIG. 8B is a longitudinal section of the workpiece material with the channel-shaped cross section after subjected to bending.
Figure 9A:
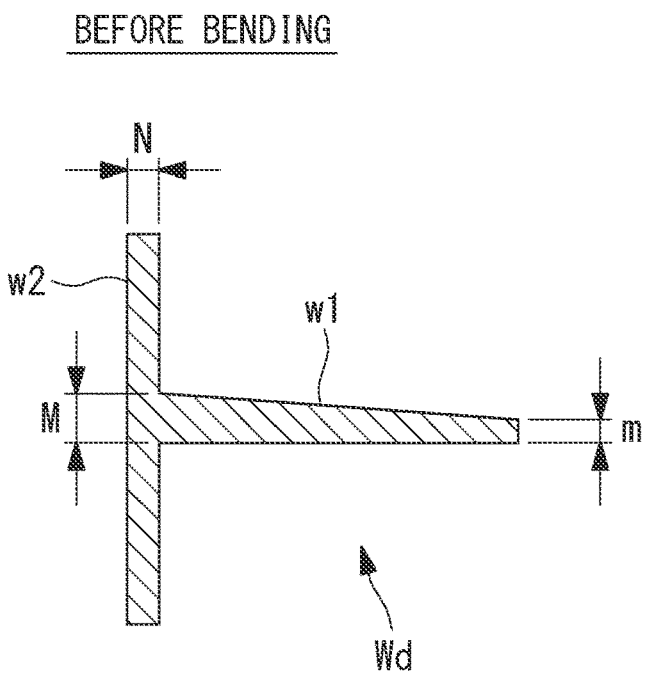
FIG. 9A is a longitudinal section of a workpiece material with a T-shaped cross section before subjected to bending.
Figure 9B:
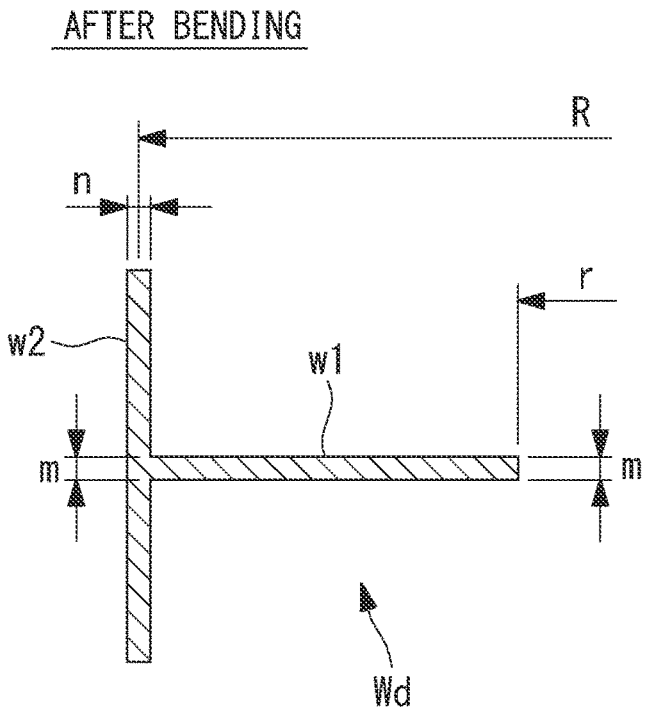
FIG. 9B is a longitudinal section of the workpiece material with the T-shaped cross section after subjected to bending.
Figure 10:
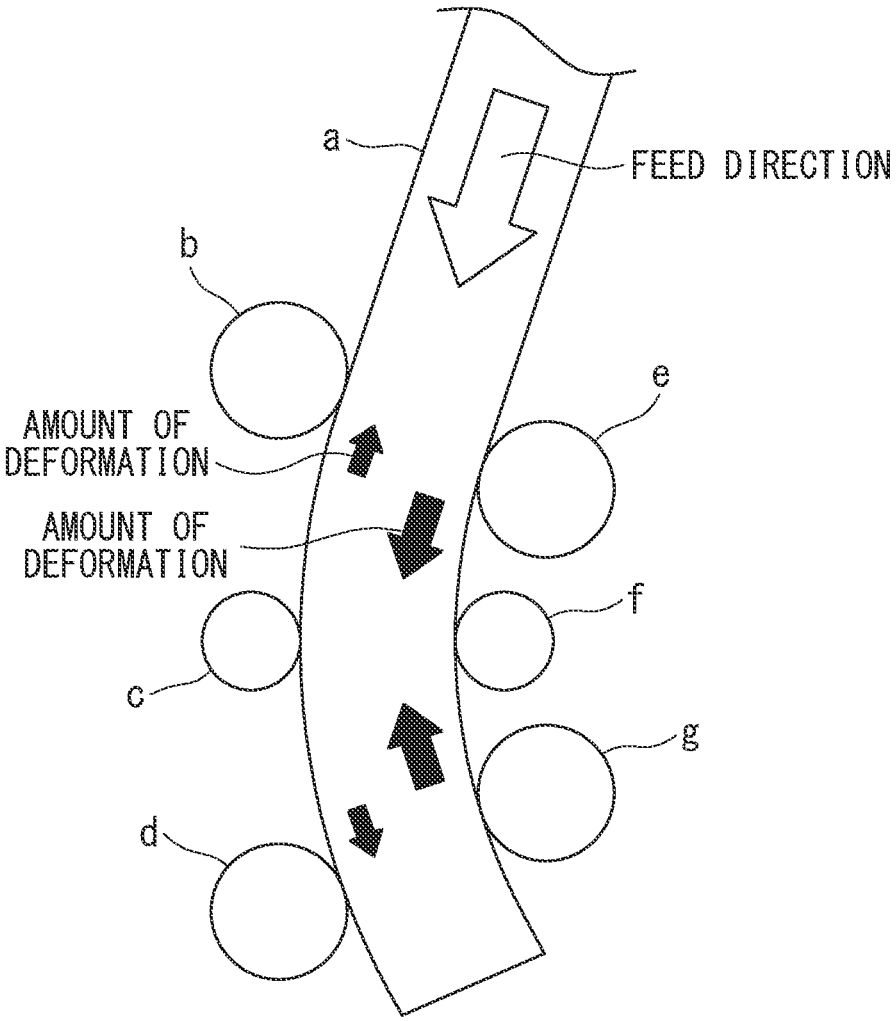
FIG. 10 Prior Art
FIG. 10 is a plan view illustrating a workpiece material and rollers involved in rolling being a conventional technique.

For example, the present invention can include a workpiece material Wb with a crank-shaped (Z-shaped) cross section as illustrated in FIGS. 7A and 7B, a workpiece material We with a channel-shaped cross section as illustrated in FIGS. 8A and 8B, a workpiece material Wd with a T-shaped cross section as illustrated in FIGS. 9A and 9B, and a workpiece material with an H-shaped or I-shaped cross section (not shown). In every case, thickness dimensions m, M, n, N, and the like of thickness portions w1, w2, and w3 in the cross section along the bend radius direction r (R) of the material are set to increase from the inner side toward the outer side along the bend radius direction r (R), as is the case with the second embodiment. The workpiece material can thus be bent by a plurality of cylindrical rollers without difficulty and with high accuracy, as is the case with the workpiece material Wa having the L-shaped cross section.

REFERENCE SIGNS LIST

1, 2 roller
10 rolling machine
11, 12 roller unit
13, 15 cylindrical roller (one roller)
14, 16 cylindrical roller (another roller)
D amount of rolling
M, N thickness dimension of outer peripheral part of bend radius before bending
m, n thickness dimension of inner peripheral part of bend radius
W, Wa, Wb, Wc, Wd workpiece material
w1, w2, w3 thickness portion
R outer radius dimension after bending
r inner radius dimension after bending

The invention claimed is:

1. A bending method that feeds a workpiece material made of metal between rollers and bends the workpiece material while rolling the workpiece material with the rollers, the workpiece material having an elongated shape, and a first thickness portion and a second thickness portion connected to each other and forming a setting angle of 90 degrees, the bending method comprising the steps of:

before bending, making a shape of the workpiece material a straight line or a bend with a bend radius dimension larger than a target bend radius dimension;

before bending, setting a thickness dimension of a cross section of the first thickness portion along a bend radius direction so as to increase from an inner side toward an outer side in the bend radius direction, and setting a thickness dimension on an outer peripheral side of the first thickness portion to be a dimension M and a thickness dimension on an inner peripheral side of the first thickness portion to be a dimension m, the dimension m being also a target thickness dimension in a cross section along the bend radius direction of the first thickness portion after bending;

before bending, setting a thickness dimension of a cross section of the second thickness portion to be a constant dimension N;

wherein M equals to m(R/r), and N equals to n(R/r) where n is a target thickness dimension of a cross section of the second thickness portion after bending, R is an outer radius dimension of the first thickness portion after bending, and r is an inner radius dimension of the first thickness portion after bending, and feeding the workpiece material, with the dimensions set before bending, between the rollers and bending the workpiece material while rolling the workpiece material with the rollers.

2. The bending method according to claim 1, wherein the rollers includes a first roller unit having two cylindrical rollers for the first thickness portion, and a second roller unit having two cylindrical rollers for the second thickness portion, a distance between the two cylindrical rollers for the first roller unit having the target thickness dimension n, and a distance between the two cylindrical rollers for the second roller unit having the dimension m, the workpiece material passing between the first and second roller units.

* * * * *